US005537928A

United States Patent [19]

Schneider

[11] Patent Number: 5,537,928

[45] Date of Patent: Jul. 23, 1996

[54] PIGGYBACK BOMB DAMAGE ASSESSMENT SYSTEM

[75] Inventor: Arthur J. Schneider, Tucson, Ariz.

[73] Assignee: Hughes Missile Systems Company, Los Angeles, Calif.

[21] Appl. No.: 422,473

[22] Filed: Apr. 17, 1995

[51] Int. Cl.[6] ..... F42B 15/00

[52] U.S. Cl. ..... 102/293; 89/1.11; 244/3.24

[58] Field of Search ..... 102/293, 386, 102/387, 388, 393; 89/1.11; 244/3.24, 31, 32

[56] References Cited

U.S. PATENT DOCUMENTS

| | | | |
|---|---|---|---|
| 3,866,858 | 2/1975 | Rattenberry | 244/32 |
| 4,691,636 | 9/1987 | Witt et al. | 102/387 |
| 5,056,740 | 10/1991 | Roth et al. | 89/1.11 |
| 5,111,748 | 5/1992 | Thurner et al. | 102/387 |
| 5,115,997 | 5/1992 | Peterson | 244/31 |
| 5,188,315 | 2/1993 | Foitzik et al. | 102/387 |
| 5,339,742 | 8/1994 | Hulderman et al. | 102/387 |
| 5,467,681 | 11/1995 | Liberman | 89/1.11 |
| 5,470,032 | 11/1995 | Williams, Jr. et al. | 244/31 |

*Primary Examiner*—Michael J. Carone
*Assistant Examiner*—Theresa M. Wesson
*Attorney, Agent, or Firm*—Charles D. Brown; Wanda Denson-Low

[57] ABSTRACT

An autonomous bomb damage assessment system that is piggybacked to a bomb to provide imagery of a bombed area immediately after bomb delivery. The bomb damage assessment system comprises a housing that is releasably secured to the bomb. An imaging system is disposed at one end of the housing and a folded inflatable balloon is disposed at the other end of the housing. An inflation device is provided for inflating the balloon with a lighter-than-air gas such as helium. A proximity fuze is used to sense the location of the ground, for causing the system to be ejected away from the bomb shortly before bomb impact, and for causing the inflation device to inflate the balloon. A data link is disposed in the housing for transmitting images derived from the imaging system to a remote location. The present invention provides imagery of a bombed area immediately after bomb delivery. The lighter than air characteristic of the system allows a dwell time over the bombed area so debris and dust can settle. Fine resolution and short range provide detailed images. Television or infrared cameras may be used as the imaging system 13 to permit for day or night missions. The data link allows images to be recorded in an aircraft sent via satellite to a recording center. The images may then be flown back to a base or relayed from the aircraft to the base using another data link. Bomb damage assessment may be performed at the base within minutes after an attack.

7 Claims, 1 Drawing Sheet

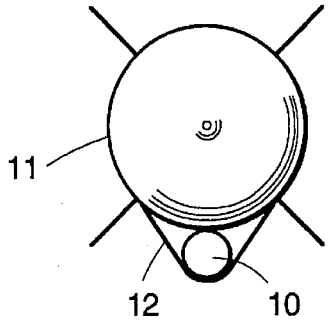
Fig. 1
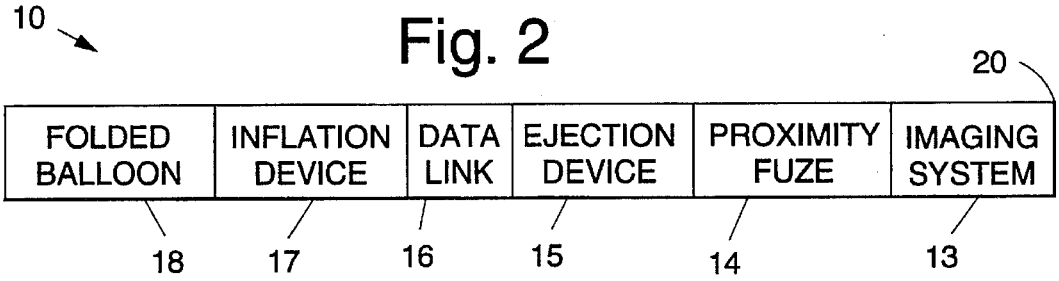
Fig. 2
Fig. 3
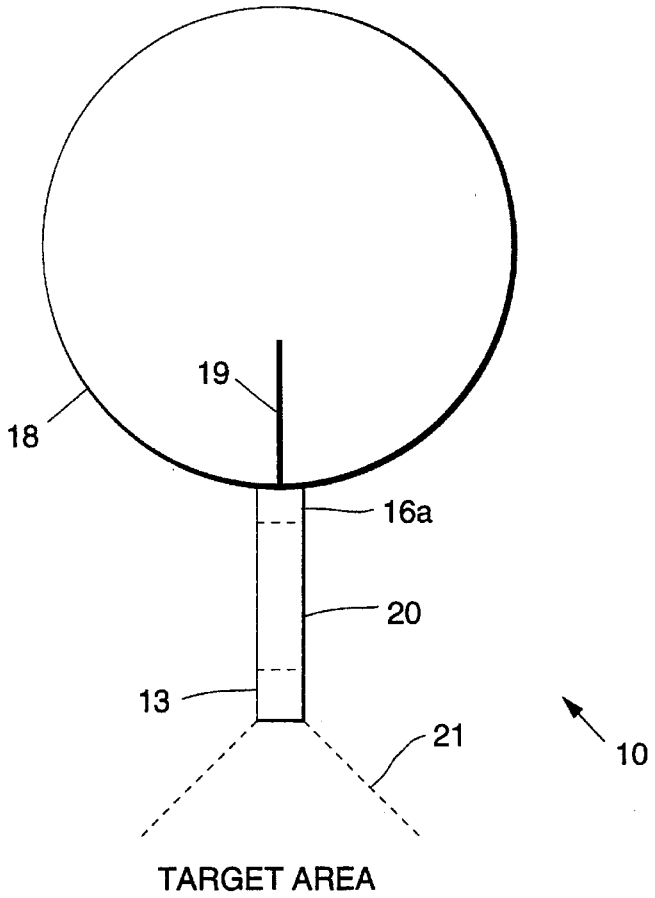

PIGGYBACK BOMB DAMAGE ASSESSMENT SYSTEM

BACKGROUND

The present invention relates generally to bomb damage assessment systems, and more particularly to a bomb damage assessment system comprising an imaging system that may be piggybacked on a bomb to provide imagery of a bombed area immediately after bomb delivery.

Prior art relating to bomb damage assessment systems includes satellites incorporating television or infrared cameras. Bombed areas are imaged using the cameras after bomb delivery. However, imaging results are dependent upon good weather in target areas. There is also a time delay until the satellite passes above the target area. Furthermore, satellite systems are relatively expensive to operate.

Unmanned air vehicles have been used to carry cameras that either record or relay imagery back to an operating base. The unmanned air vehicles are relatively expensive, but may be re-used. Coordination of the flight of the unmanned air vehicle with the attack of the target area is required, and the target must be within the operating range of the unmanned air vehicle.

Reconnaissance aircraft have been used that generally operate at high altitude and require clear weather to assess the target area. In essence, reconnaissance aircraft represent a very expensive long range version of an unmanned air vehicle.

Therefore, it is an objective of the present invention to provide a bomb damage assessment system that is cost effective compared with conventional systems. It is a further objective of the present invention to provide a bomb damage assessment system that may be piggybacked on a bomb to provide imagery of a bombed area immediately after bomb delivery.

SUMMARY OF THE INVENTION

In order to meet the above and other objectives, the present invention is an autonomous bomb damage assessment system that comprises an imaging system that is piggybacked on a bomb to provide imagery of a bombed area immediately after bomb delivery. The bomb damage assessment system comprises a housing that is releasably secured to the bomb. An imaging system disposed in the housing and a folded inflatable balloon is coupled to the housing. Inflation means is disposed in the housing and coupled to the folded balloon for inflating the balloon with a lighter-than-air gas such as helium. A proximity fuze is disposed in the housing for sensing the location of the ground, for causing the housing to be ejected away from the bomb shortly before bomb impact, and for causing the inflation device to inflate the folded balloon. A data link is disposed in the housing for transmitting images derived from the imaging system to a remote location. The data link comprises a transmitter and an antenna.

The autonomous system may be secured to any air-to-ground bomb. The proximity fuze senses the ground and cause the system to be self ejected from the bomb shortly before impact. The folded balloon is then inflated with lighter-than-air gas, such as helium, to decelerate the system. Since helium gas, for example, is used, the inflated balloon will rise. The pendulous camera points downward toward the target area. The imaging system may employ a 512 element by 512 element detector array, and a wide field of view may be used to image the bombed area to assess damage. The data link transmits images to a remote location, such as an aircraft or to a recording center via a satellite, for example.

The present invention provides imagery of a bombed area immediately after bomb delivery. The lighter than air characteristic allows a dwell time over the bombed area so debris and dust can settle. Fine resolution and short range provide detailed images. Either television or infrared cameras may be used as the imaging system to permit for day or night missions. The data link allows images to be recorded in the launch aircraft or a nearby aircraft. The images may be flown back to a base or relayed from the aircraft to the base by another data link using a satellite, for example. Bomb damage assessment may be performed at the base within minutes after an attack.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which:

FIG. 1 illustrates a bomb carrying an autonomous bomb damage assessment system in accordance with the principles of the present invention;

FIG. 2 illustrates the autonomous bomb damage assessment system of FIG. 1; and FIG. 3 illustrates the autonomous bomb damage assessment system in a deployed state.

DETAILED DESCRIPTION

Referring to the drawing figures, FIG. 1 illustrates an autonomous bomb damage assessment system 10 in accordance with the principles of the present invention. The autonomous bomb damage assessment system 10 is piggybacked or otherwise secured to a bomb 11 by means of a strap 12, for example, and provides imagery of a bombed area immediately after bomb delivery.

FIG. 2 illustrates details of the autonomous bomb damage assessment system 10 of FIG. 1. FIG. 3 illustrates the autonomous bomb damage assessment system 10 in a deployed state. The bomb damage assessment system 10 comprises a housing 20 that is releasably secured to the bomb 11. An imaging system 13 is disposed at one end of the housing 20 and a folded inflatable balloon 18 is disposed in an opposite end of the housing. An inflation device 17, such as a releasable inflation canister, for example, is disposed in the housing 20 and coupled to the folded balloon 18 for inflating the balloon 18 with a lighter-than-air gas such as helium. A proximity fuze 14 is disposed in the housing 20 for sensing the location of the ground, for causing the housing 20 to be ejected away from the bomb 11 shortly before bomb impact, and for causing the inflation device 17 to inflate the folded balloon 18. A data link 16 is disposed in the housing 20 for transmitting images derived from the imaging system 13 to a remote location. The data link 16 comprises a transmitter 16a and an antenna 19 (FIG. 3). The antenna 19 extends from the data link 16 subsequent to inflation of the balloon 18.

In operation, the autonomous bomb damage assessment system 10 may be secured to any air-to-ground bomb 11. The proximity fuze 14 senses the ground and causes the system 10 to be ejected from the bomb 11 shortly before impact. The folded balloon 18 is then inflated with lighter-than-air gas, such as helium, to decelerate the system 10. Since helium gas, for example, is used, the inflated balloon 18 will rise. The pendulous imaging system 13, or camera, points downward toward the target area of the bomb 11. The imaging system 13 may employ a 512 element by 512 element detector array, for example, having a wide field of view 21 that may be used to image the bombed area to assess damage. The data link 16 comprising the transmitter **16*a* and antenna 19** transmits images to a remote location, such as an aircraft or to a recording center via a satellite, for example.

The present invention provides imagery of a bombed area immediately after bomb delivery. The lighter than air characteristic of the autonomous bomb damage assessment system 10 allows a dwell time over the bombed area so debris and dust can settle. Fine resolution and relatively short range provide for detailed images. Either television or infrared cameras may be used as the imaging system 13 to permit for day or night missions. The data link 16 allows images to be recorded in a launch aircraft or a nearby aircraft. The images may be flown back to a base or relayed from the aircraft to the base by a separate data link using a satellite, for example. Bomb damage assessment may be performed at the base within minutes after an attack.

Thus there has been described a new and improved bomb damage assessment system that may be piggybacked to a bomb to provide imagery of a bombed area immediately after bomb delivery. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A bomb damage assessment system for providing imagery of a bombed area immediately after delivery of a bomb, said system comprising:

a housing;

means for releasably securing the housing to the bomb;

an imaging system disposed at a first end of the housing;

a folded inflatable balloon disposed at a second end of the housing;

inflation means disposed in the housing and coupled to the folded balloon for inflating the balloon with a lighter-than-air gas;

a proximity fuze disposed in the housing for sensing the location of the ground and for causing the housing to be ejected away from the bomb shortly before bomb impact and for causing the inflation means to inflate the folded balloon; and a data link disposed in the housing for transmitting images derived from the imaging system to a remote location.

2. The system of claim 1 wherein the imaging system comprises a television camera.

3. The system of claim 1 wherein the imaging system comprises an infrared camera.

4. The system of claim 3 wherein the infrared camera comprises a detector array.

5. The system of claim 4 wherein the detector array comprises a 512 element by 512 element detector array.

6. The system of claim 1 wherein the lighter-than-air gas comprises helium.

7. The system of claim 1 wherein the data link 16 comprises a transmitter and an antenna.

* * * * *